United States Patent [19]

Cherian et al.

[11] Patent Number: 4,823,102

[45] Date of Patent: Apr. 18, 1989

[54] MAGNETIC ROLL FOR A COPIER

[75] Inventors: Abraham Cherian; Joseph C. Foerster, both of Webster, N.Y.

[73] Assignee: Xerox Corporation, Stamford, Conn.

[21] Appl. No.: 104,146

[22] Filed: Oct. 5, 1987

[51] Int. Cl.[4] ..... H01F 7/02

[52] U.S. Cl. ..... 335/306; 355/3 DD; 118/658; 29/110

[58] Field of Search ..... 335/303, 306; 355/3 DR, 355/3 DD; 118/657, 658; 29/110, 116.1

[56] References Cited

U.S. PATENT DOCUMENTS 4,451,134 5/1984 Fukuchi et al. ..... 118/658 X
4,558,294 12/1985 Yamashita ..... 335/303
4,580,121 4/1986 Ogawa ..... 335/303
4,608,737 5/1986 Parks et al. ..... 29/110
4,638,281 1/1987 Baermann ..... 335/303

*Primary Examiner*—George Harris
*Attorney, Agent, or Firm*—H. Fleischer; J. E. Beck; R. Zibelli

[57] ABSTRACT

A magnetic roll which is used in a processing station of an electrostatographic printing machine. The roll has a central portion with a plurality of spaced fins extending generally radially outwardly therefrom. A shaft extends outwardly from opposed ends of the central portion along the longitudinal axis thereof. A magnet is secured in each space between adjacent fins. A sleeve is rotatably supported on the shaft.

18 Claims, 3 Drawing Sheets

MAGNETIC ROLL FOR A COPIER

This invention relates generally to an electrophotographic printing machine, and more particularly concerns a magnetic roll for use in a processing station of an electrophotographic printing machine.

In the process of electrophotographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. Generally, the developer material comprises toner particles adhering triboelectrically to carrier granules. The toner particles are attracted from the carrier granules to form a toner powder image on the photoconductive member which corresponds to the informational areas contained within the original document. This toner powder image is subsequently transferred to a copy sheet and permanently affixed thereto in image configuration.

In electrophotographic printing machines, magnetic rolls are frequently employed in the developing station and the cleaning station. Typically, the magnetic roll includes a stationary magnet having a rotating tube positioned concentrically thereabout. At the developing station, a developer material of magnetic carrier granules having toner particles adhering triboelectrically thereto is attracted to the tube by the magnetic field generated by the magnetic roll. The tube surface is usually roughened so that the frictional force between the developer material and the tube causes the developer material to rotate with the tube. The developer material is advanced by the tube to a position closely adjacent the electrostatic latent image recorded on the photoconductive member. The latent image attracts the toner particles forming a toner powder image in the photoconductive member. At the cleaning station, a layer of carrier granules adheres to the tube and moves therewith. As the layer of carrier granules pass closely adjacent to the photoconductive member, residual toner particles are attracted to the layer of carrier granules and move therewith away from the photoconductive member. In this way, residual toner particles are cleaned from the photoconductive member. In both applications, it is desirable to manufacture the magnetic roll in an inexpensive, reliable manner.

Various techniques have been devised for manufacturing magnetic rolls. The following patents appear to be relevant:

U.S. Pat. No. 4,558,294 Patentee: Yamashita Issued: Dec. 10, 1985;

U.S. Pat. No. 4,580,121 Patentee: Ogawa Issued: Apr. 1, 1986;

U.S. Pat. No. 4,608,737 Patentee: Parks et al. Issued: Sept. 2, 1986;

U.S. Pat. No. 4,638,281 Patentee: Baermann Issued: Jan. 20, 1987.

The pertinent portions of the foregoing patents may be briefly summarized as follows:

U.S. Pat. No. 4,558,294 discloses a method for assembling a magnetic roll in which a plurality of plastic magnetic members are bonded to a polygonal supporting base and each other in a ridge-groove relationship.

U.S. Pat. No. 4,580,121 describes a magnetic roll having an impeller shaped support and a plurality of rubber matrix magnets mounted on the support at desired locations. The aluminum impeller shaped support with six fins is formed by extrusion. The magnetic members are fitted into the regions defined by the fins, and a heat shrinkable tubing is disposed about the magnetic members to form an integrated structure.

U.S. Pat. No. 4,608,737 discloses a magnetic developer roll made from a plastic material at low cost. Rectilinear ribs of plastic magnets support the structure along its axis. Radially grooved hubs hold the magnetic ribs in place by adhesive tape. A cylindrical shell of conductive material covers the magnetic structure.

U.S. Pat. No. 4,638,281 describes a method for manufacturing a magnetic roll in which strip shaped permanent magnetic members can be circumferentially positioned to provide a predetermined magnetic field and secured to the supporting base by an injection moldable plastic.

In accordance with one aspect of the present invention, there is provided a magnetic roll for use in a processing station of an electrostatographic printing machine. The magnetic roll includes a support comprising a central portion. A plurality of spaced fins extend generally radially outwardly from the central portion. A shaft extends outwardly from opposed ends of the central portion along the longitudinal axis thereof. A magnet is secured in each space between adjacent fins. The magnets are positioned in a selected orientation with respect to one another so as to generate a predetermined magnetic field. Means are provided for rotatably supporting a sleeve on the shaft.

Pursuant to another aspect of the present invention, there is provided a method of manufacturing a magnetic roll for use in a processing station of an electrostatographic printing machine. The manufacturing method includes the steps of forming a support comprising a central portion, a plurality of spaced fins extending generally radially outwardly from the central portion and a shaft extending outwardly form opposed ends of the central portion along the longitudinal axis thereof. Magnets are secured in the spaces between adjacent fins in a selected orientation with respect to one another so as to generate a predetermined magnetic field. A sleeve is mounted rotatably on the shaft of the support.

Other aspects of the present invention will become apparent as the following description proceeds and upon reference to the drawings, in which.

While the present invention will be described hereinafter in conjunction with a preferred embodiment and method of manufacture, it will be understood that it is not intended to limit the invention to this embodiment or method of manufacture. On the contrary, it is intended to cover all alternatives, modifications and equivalents as may be included within the spirit and scope of the invention as defined by the appended claims.

Figure 1:
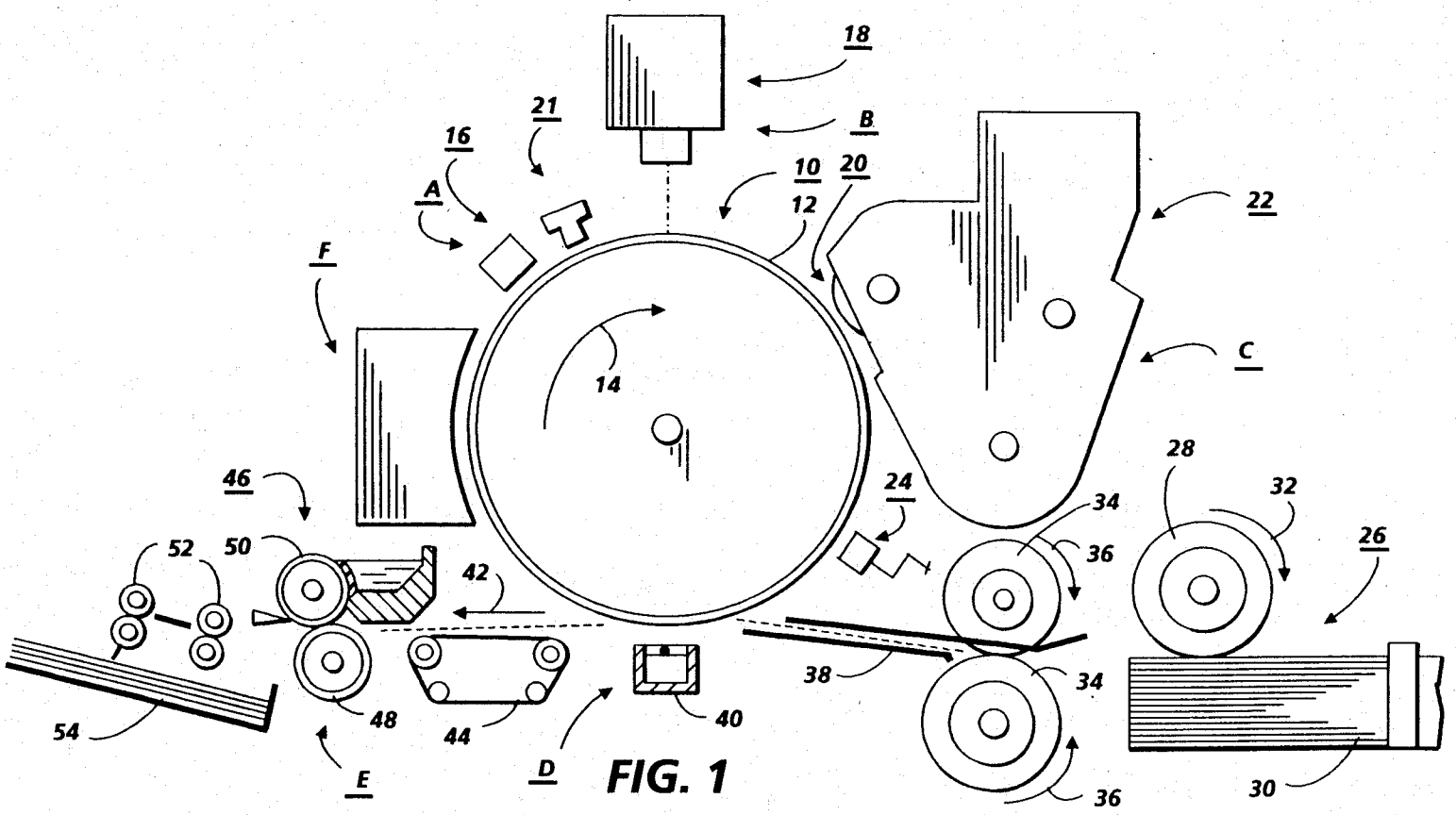
FIG. 1 is a schematic elevational view showing an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative electrophotographic printing machine incorporating the magnetic roll of the present invention therein. It will become evident from the following discussion that this magnetic roll is equally well suited for use in a wide variety of electrostatographic printing machines and is not necessarily limited in its application to the particular embodiment or method of manufacture described herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12 adhering to a conductive substrate. Preferably, photoconductive surface 12 comprises a selenium alloy with the conductive substrate being an electrically grounded aluminum alloy. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B includes an exposure system, indicated generally by the reference numeral 18. Exposure system 18 includes lamps which illuminate an original document positioned face down upon a transparent platen. The light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the information in the original document. Drum 10 advances the electrostatic latent image recorded on photoconductive surface 12 to development station C.

At development station C, a developer unit, indicated generally by the reference numeral 22, has a magnetic roll, indicated generally by the reference numeral 20, which transports a developer mixture of carrier granules having toner particles adhering triboelectrically thereto into contact with the electrostatic latent image. Toner particles are attracted from the carrier granules to the latent image forming a toner powder image. The detailed structure of magnetic roll 20 will be described hereinafter with reference to FIGS. 2 through 4, inclusive.

After development of the electrostatic latent image, drum 10 advances the toner powder image to transfer station D. At transfer station D, a sheet of support material is moved into contact with the toner powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 28 rotates in the direction of arrow 32 to advance the uppermost sheet into a nip defined by forwarding rollers 34. Forwarding rollers 34 rotate in the direction of arrow 36 to advance the sheet into chute 38. Chute 38 directs the advancing sheet into contact with photoconductive surface 12 in a timed sequence so that the toner powder image developed thereon contacts the advancing sheet at transfer station D.

Transfer station D includes a corona generating device 40 which sprays ions onto the backside of the sheet. This attracts the toner powder image from photoconductive surface 12 to the sheet. After transfer, the sheet continues to move in the direction of arrow 42 on conveyor 44 to advance to fusing station E.

Fusing station E includes a fuser assembly, indicated generally by the reference numeral 46, which permanently affixes the transferred toner powder image to the sheet. Preferably, fuser assembly 46 includes a back-up roller 48 and a heated fuser roller 50. The sheet passes between fuser roller 50 and back-up roller 48 with the powder image contacting fuser roller 50. In this manner, the toner powder image is permanently affixed to the sheet. After fusing, forwarding rollers 52 advance the sheet to catch tray 54 for subsequent removal from the printing machine by the operator.

After the powder image is transferred from photoconductive surface 12 to the copy sheet, drum 10 rotates the photoconductive surface to cleaning station F. At cleaning station F, a cleaning system, employing a magnetic roll substantially identical to the magnetic roll 20 of developer unit 22, removes the residual particles adhering to photoconductive surface 12. The magnetic roll transports carrier granules closely adjacent to the photoconductive surface to attract residual toner particles thereto. In this way, the residual toner particles are removed from photoconductive surface 12.

It is believed that the foregoing description is sufficient for purposes of the present invention to illustrate the general operation of an electrophotographic printing machine incorporating the features of the present invention therein.

Figure 2:
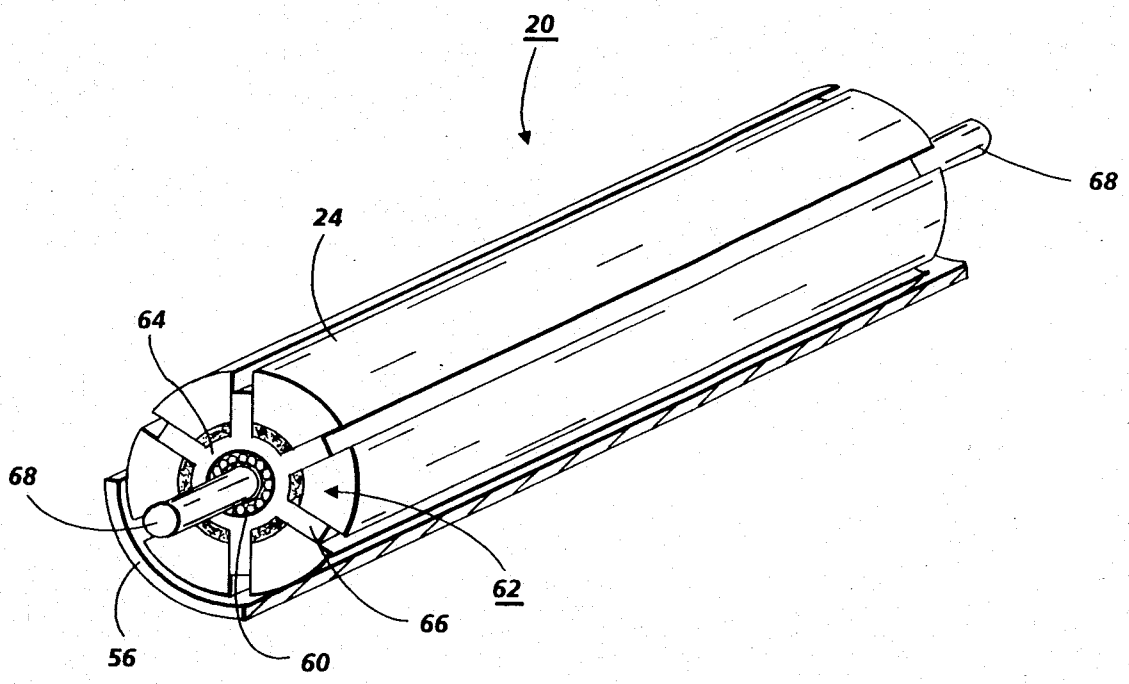
FIG. 2 is a perspective view showing the magnetic roll used in the FIG. 1 printing machine.
Figure 3:
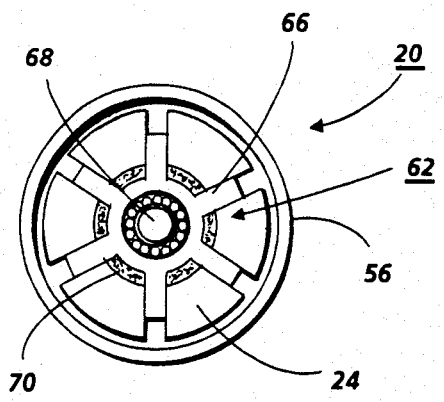
FIG. 3 is a side elevational view illustrating the FIG. 2 magnetic roll.
Figure 4:
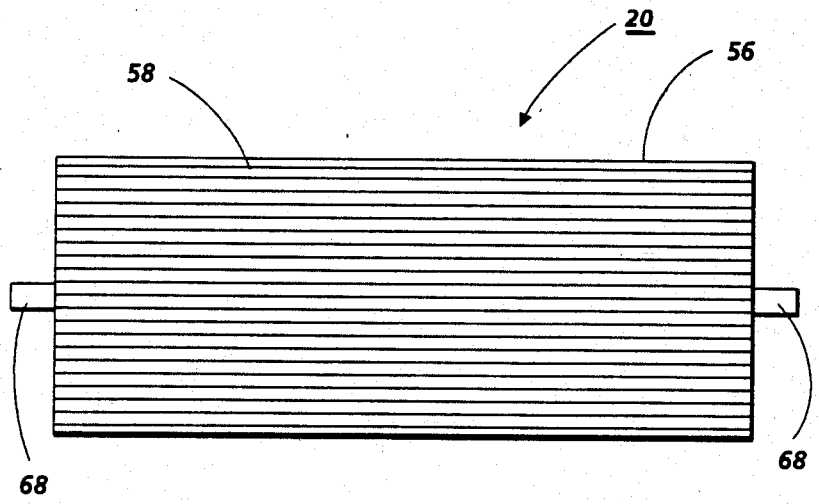
FIG. 4 is a front elevational view depicting the FIG. 2 magnetic roll.

Referring now to the specific subject matter of the present invention, FIGS. 2 through 4, inclusive, depict magnetic roll 20 in greater detail. As shown thereat, magnetic roll 20 includes a non-magnetic tubular member or sleeve 56 having knurls 58 (FIG. 4) in the exterior circumferential surface thereof. Knurls 58 extend in a longitudinal direction substantially parallel to the longitudinal axis of sleeve 56. Sleeve 56 is journalled for rotation by suitable means such as needle bearings 60. A support, indicated generally by the reference numeral 62, is mounted within sleeve 56 and serves as a fixed mounting for magnets 24. Support 62 includes a central portion 64 which is cylindrical in shape. A plurality of substantially equally spaced fins 66 extend generally outwardly from central portion 64. The fins 66 are formed integrally with the central portion 64. A shaft 68 extends outwardly from opposed ends of the central portion 64 along the longitudinal axis thereof. Shaft 68 is also formed integrally with the central portion 64 with one portion thereof extending outwardly form one end of central portion 64 and the other portion thereof extending outwardly from the other end of central portion 64. A pair of needle bearings 60 are mounted on shaft 68. One needle bearing is mounted on the portion of shaft 68 extending outwardly from one end of central portion 64 and the other needle bearing 60 is mounted on the other portion of shaft 68 extending outwardly from the other end of central portion 64. Magnets 24 are secured in the space between adjacent fins 66. One magnet 24 is secured in each space between adjacent fins 66. Inasmuch as there are six fins 66 defining six spaces, there are six magnets 24 secured to support 62. Magnets 24 are bonded to support 62 by a suitable bonding material 70, such as an adhesive or plastic material. For example, an injection moldable plastic may be inserted into the spaces between adjacent fins 66 for fixing the magnets. Alternatively, a hot melt plastic or a fast curing epoxy glue may be used to secure the magnets 24 in place. During assembly, a magnetic field is generated to hold the magnets 24 in a selected position. The magnets are oriented with respect to one another to obtain a predetermined magnetic field. Hall probes are employed to detect the intensity of the magnetic field being generated by the magnets 24. After the magnets are oriented with respect to one another to generate the predetermined magnetic field. The magnets are held in this orientation by a magnetic field and bonding material 70 is allowed to cure. In this manner, the magnets are fixed in the preferred orientation so as to generate the predetermined magnetic field. In operation, Sleeve 56 rotates to advance the developer material into contact with photoconductive surface 12 of drum 10. By way of example, sleeve 56 is made preferably from an extruded aluminum tube having straight knurls 58 therein. Magnets 24 are made from extruded and premagnetized rubber magnets. Support 62 is an extruded member in which central portion 64, fins 66, and shaft 68 are integral with one another. The mounting surfaces for the magnets and needle bearings are formed during the extrusion process.

The magnetic roll 20 is manufactured by selecting a light weight material, such as aluminum for support 62. Support 62 is formed by extruding the aluminum with the central portion 64, fins 66 and shaft 68 integral with one another. The central portion is extruded in a cylindrical shape. Sleeve 56 is extruded from aluminum in a cylindrical shape with knurls in the exterior circumferential surface substantially parallel to the longitudinal axis thereof. Magnets 24 are selected from extruded premagnetized magnets. A bonding material 70, such as an adhesive or plastic material, is placed in the space between adjacent fins 66. The magnets are positioned or oriented with respect to one another to generate a predetermined magnetic field. A magnetic field is applied on magnets 24 to hold the magnets in position until the bonding material has cured. A pair of needle bearings are placed on shaft 68. One of the needle bearings is placed on the portion of the shaft extending outwardly from one end of the central portion and the other needle bearing is placed on the portion of the shaft 68 extending outwardly from the other end of central portion 64. Sleeve 56 is then mounted on the needle bearings to complete the assembly of magnetic roll 20.

In recapitulation, magnetic roll 20 is made from an extruded aluminum support 62 having a cylindrical central portion 64 with spaced fins 66 extending outwardly therefrom and a shaft extending outwardly from opposed ends along the longitudinal axis thereof. Needle bearings 60 are mounted on shaft 68 for supporting rotatably an extruded aluminum sleeve 56 having knurls 58 on the exterior circumferential surface substantially parallel to the longitudinal axis thereof. A magnetic roll of this type is more easily assembled with a low rejection rate and reduced manufacturing cost.

It is, therefore, apparent that there has been provided, in accordance with the present invention, a magnetic roll that fully satisfies the aims and advantages hereinbefore set forth. While this invention has been described in conjunction with a specific embodiment and method of manufacture, it is evident that many alternatives, modifications, and variations will be apparent to those skilled in the art. Accordingly, it is intended to embrace all such alternatives, modifications and variations that fall within the spirit and scope of the appended claims.

We claim:

1. A magnetic roll for use in a processing station of an electrostatographic printing machine, including:

a support comprising a central portion, a plurality of spaced fins extending generally radially outwardly from said central portion, and a shaft extending outwardly from opposed ends of said central portion along the longitudinal axis thereof, said central portion being integrally formed with said plurality of fins and said shaft;

a plurality of magnets with each of said plurality of magnets being secured to said support in the space between adjacent fins in a selected orientation with respect to one another and extending a distance substantially equal to the length of said central portion so as to generate a predetermined magnetic field;

a sleeve; and means for rotatably supporting said sleeve on said shaft of said support.

2. A roll according to claim 1, wherein said central portion is cylindrical in shape.

3. A roll according to claim 2, wherein said sleeve is cylindrical in shape having a plurality of knurls in the exterior circumferential surface thereof substantially parallel to the longitudinal axis thereof.

4. A roll according to claim 1, wherein each of said plurality of magnets is secured with an adhesive material.

5. A roll according to claim 1, wherein each of said plurality of magnets is secured with a plastic material.

6. A roll according to claim 1, wherein said support is made from a light weight material.

7. A roll according to claim 6, wherein said support is made from aluminum.

8. A roll according to claim 1, wherein said plurality of magnets are made from extruded, pre-magnetized magnets.

9. A roll according to claim 1, wherein said rotatably supporting means includes a pair of needle bearings with one of said pair of needle bearings being mounted on the portion of said shaft extending outwardly from one end of said central portion and the other of said pair of needle bearings being mounted on the portion of said shaft extending outwardly from the other end of said central portion.

10. A method of manufacturing a magnetic roll for use in a processing station of an electrostatographic printing machine, including the steps of:

forming a support comprising a central portion, a plurality of spaced fins extending generally radially outwardly from the central portion, and a shaft extending outwardly from opposed ends of the central portion along the longitudinal axis thereof with the central portion, fins and shaft being integral with one another;

securing magnets on the support in the spaces between adjacent fins in a selected orientation with respect to one another so as to generate a predetermined magnetic field with the magnets extending a distance substantially equal to the length of the central portion; and mounting rotatably a sleeve on the shaft of the support.

11. A method according to claim 10, wherein said step of forming includes extruding the central portion of the support in a cylindrical shape.

12. A method according to claim 11, further including the step of making a sleeve in a cylindrical shape with knurls in the exterior surface circumferential surface substantially parallel to the longitudinal axis thereof.

13. A method according to claim 12, wherein said step of securing includes the steps of:

placing an adhesive material in the space between adjacent fins;

positioning magnets in the spaces between adjacent fins;

curing the adhesive material to secure the magnets in the spaces between adjacent fins; and applying a magnetic field to hold the magnets in position during said step of curing.

14. A method according to claim 12, wherein said step of securing includes the steps of:

placing a plastic material in the space between adjacent fins;

positioning magnets in the spaces between adjacent fins;

curing the plastic material to secure the magnets in the spaces between adjacent fins; and applying a magnetic field to hold the magnets in position during said step of curing.

15. A method according to claim 12, wherein said step of mounting includes the steps of:

placing a pair of needle bearings on the support with one of the needle bearings being placed on the shaft extending outwardly from one end of the central portion and the other one of the needle bearings being placed on the shaft extending outwardly from the other end of the central portion; and mounting the sleeve on the pair of needle bearings.

16. A method according to claim 12, further including the step of selecting a light weight material to be used as the material for the support in said step of forming.

17. A method according to claim 12, further including the step of selecting aluminum to be used as the material for the support in said step of forming.

18. A method according to claim 12, further including the step of extruding pre-magnetized magnets to be used as the magnets in said step of securing.

* * * * *